US011771234B2

(12) United States Patent
Pike et al.

(10) Patent No.: US 11,771,234 B2
(45) Date of Patent: Oct. 3, 2023

(54) MATTRESS SECURING APPARATUS AND METHOD OF USING THE SAME

(71) Applicants: Alice Nicole Pike, Evansville, IN (US); Steven Charles Pike, Evansville, IN (US)

(72) Inventors: Alice Nicole Pike, Evansville, IN (US); Steven Charles Pike, Evansville, IN (US)

( * ) Notice: Subject to any disclaimer, the term of this patent is extended or adjusted under 35 U.S.C. 154(b) by 47 days.

(21) Appl. No.: 17/248,010

(22) Filed: Jan. 5, 2021

(65) Prior Publication Data

US 2022/0211185 A1 Jul. 7, 2022

(51) Int. Cl.
*A47C 21/02* (2006.01)

(52) U.S. Cl.
CPC ..... *A47C 21/026* (2013.01)

(58) Field of Classification Search
CPC ..... A47C 21/00; A47C 21/02; A47C 21/026
See application file for complete search history.

(56) References Cited

U.S. PATENT DOCUMENTS 2,588,854 A * 3/1952 Lang ..... A61G 7/015 5/411
3,962,757 A 6/1976 Gedney
4,193,149 A 3/1980 Welch
4,400,836 A 8/1983 Pelura
4,520,518 A 6/1985 Reaser
4,521,970 A 6/1985 Jester
4,635,308 A 1/1987 Maggio et al.
4,646,375 A 3/1987 Parker
4,686,725 A 8/1987 Mitchell
4,726,083 A * 2/1988 Hoshall ..... A47C 21/026 297/DIG. 6
4,726,836 A * 2/1988 Gass ..... C07D 213/643 544/323
4,773,108 A 9/1988 Leever
4,782,543 A * 11/1988 Hutton ..... A47C 27/085 24/72.5
4,794,660 A 1/1989 Hawkrigg
4,967,434 A 11/1990 Hill
5,528,780 A 6/1996 Taylor
5,651,153 A 7/1997 Goodrich
5,906,878 A * 5/1999 Horning ..... A47C 31/11 297/219.1
6,684,425 B2 2/2004 Davis
6,739,002 B1 5/2004 Pannu
7,467,428 B2 12/2008 Hanes
8,321,975 B1 12/2012 Lindberg et al.
9,775,441 B2 10/2017 Burrill
10,004,340 B1 6/2018 Guerin
(Continued)

*Primary Examiner* — Fredrick C Conley
(74) *Attorney, Agent, or Firm* — Dunlap Bennett & Ludwig, PLLC

(57) ABSTRACT

A mattress securement device having a generally planar substrate dimensioned to have one or more aperture that is circumscribed by peripheral multi-directional edges of the planar substrate. An adhesive along one side of the planar substrate enables the mattress securement device to be releasably adhered to a foundation on which a mattress is supported. The weight of the mattress urges a portion thereof into the one or more apertures and other portions of the mattress against the multi-directional edges, both of which resist the mattress moving or sliding relative to the foundation.

9 Claims, 3 Drawing Sheets

(56) References Cited

U.S. PATENT DOCUMENTS

| | | | |
|---|---|---|---|
| 2002/0138902 | A1 | 10/2002 | Bennett |
| 2004/0221393 | A1 | 11/2004 | Stokes |
| 2008/0134431 | A1 | 6/2008 | Piana |
| 2009/0172881 | A1 | 7/2009 | Peterson |
| 2014/0115782 | A1 | 5/2014 | Ben-Harush |

* cited by examiner

MATTRESS SECURING APPARATUS AND METHOD OF USING THE SAME

BACKGROUND OF THE INVENTION

The present invention relates to retaining devices and, more particularly, a mattress securing apparatus and method of using the same.

The problem with a mattress sliding, moving, or shifting once placed on its foundation has likely been an annoyance since the inception of the mattress and foundation. Fastening devices heretofore devised and utilized for the purpose of retaining a mattress on its foundation are known to consist of familiar, expected, and obvious structural configurations. Such devices include the application of pins, clips, clamps and/or elastic bands, and devices that rely upon hook-and-loop fasteners and the like. None of these approaches have proven entirely satisfactory, in that they do not provide sufficient securement, they are too costly to produce, they require complete removal of the mattress or otherwise demand a significant amount of manual labor (sometimes requiring two or more people) to install, and/or they are visible and aesthetically unpleasing during use.

Mattresses are heavy and bulky, and most mattress securing systems, devices and devices require removal of the mattress for the system to be installed. Yet, none have been proven entirely satisfactory as they do not sufficiently secure the mattress. Additionally, linens and bedsheets can unintentionally snag on portions of current solutions. Moreover, some mattress securing methods utilize large sheets that can fold and bind and create a lumpy feeling through the mattress, and which are prone to tearing during the readjust process.

As can be seen, there is a need for a uniquely structured mattress securing apparatus and method of using the same so that no pins, no clamps, no teeth, no clips, no elastic bands, and no hook-and-loop fasteners are needed. Furthermore, the present invention does not require removal of the mattress to apply nor utilization of sheets of flexible material that can fold, bind or otherwise diminish the comfort and enjoyability of the mattress being secured.

The present invention can be readjusted to any position without removal of the mattress and can be easily applied by one person with minimal pressure. The apparatus of the present invention enables a semi-permanent bond with the mattress but can be repositioned by peeling the apparatus off the underlying foundation before placing in a new desired location, lending itself to the following advantages: the present invention is quiet (no crinkling or no popping sound), provides superior holding power, is not limited to one specific place but rather can be applied anywhere on the surface of the foundation. Furthermore, the foundation is not limited to a specific style — i.e., the foundation can be wood, foam, coil, as well as power base, platform bed, or hospital bed.

The apparatus provides an aperture circumscribed by a peripheral cut surface. The gravitational pressing of the mattress into the aperture and against the peripheral cuts increases the frictional connection between the apparatus and the mattress and foundation. Moreover, the aperture enables a vacuum effect and drag through creating a valley for the mattress surface to nest into, acting almost as a key in lock, wherein the mattress surface presses into the keyhole and locks it into place. In other words, the aperture creates a crevasse that the upholstery from the bottom of the mattress can anchor into, creating a flexible bond and adding drag to the mattress. As a result, the application of this frictional connection causes the foundation to adhere more strongly to the mattress thereby providing greater resistance against the tendency of the mattress to slide or move relative to the foundation. Finally, the present invention is not visible during use.

SUMMARY OF THE INVENTION

In one aspect of the present invention, a mattress securement device providing the following: a substrate that is planar and dimensioned to have one or more apertures through the substrate; a periphery of the substrate having multi- directional facets; an adhesive disposed along one of two planar surfaces of the substrate; a peel-away layer along the adhesive, wherein the periphery comprises at least two or three facets per linear inch (e.g., 41, 42, and 43 in FIG. 3), wherein each of the at least two or three facets extend between opposing planar surfaces of the substrate.

In another aspect of the present invention, method of preventing a mattress from sliding relative to a foundation that supports the mattress, the method includes the following: lifting a portion of the mattress from an upper surface of the foundation; placing a mattress securement device disclosed above in such a way that the adhesive adheres to the upper surface of the foundation; and laying the portion of the mattress onto said mattress securement device.

These and other features, aspects and advantages of the present invention will become better understood with reference to the following drawings, description and claims

DETAILED DESCRIPTION OF THE INVENTION

Figure 1:
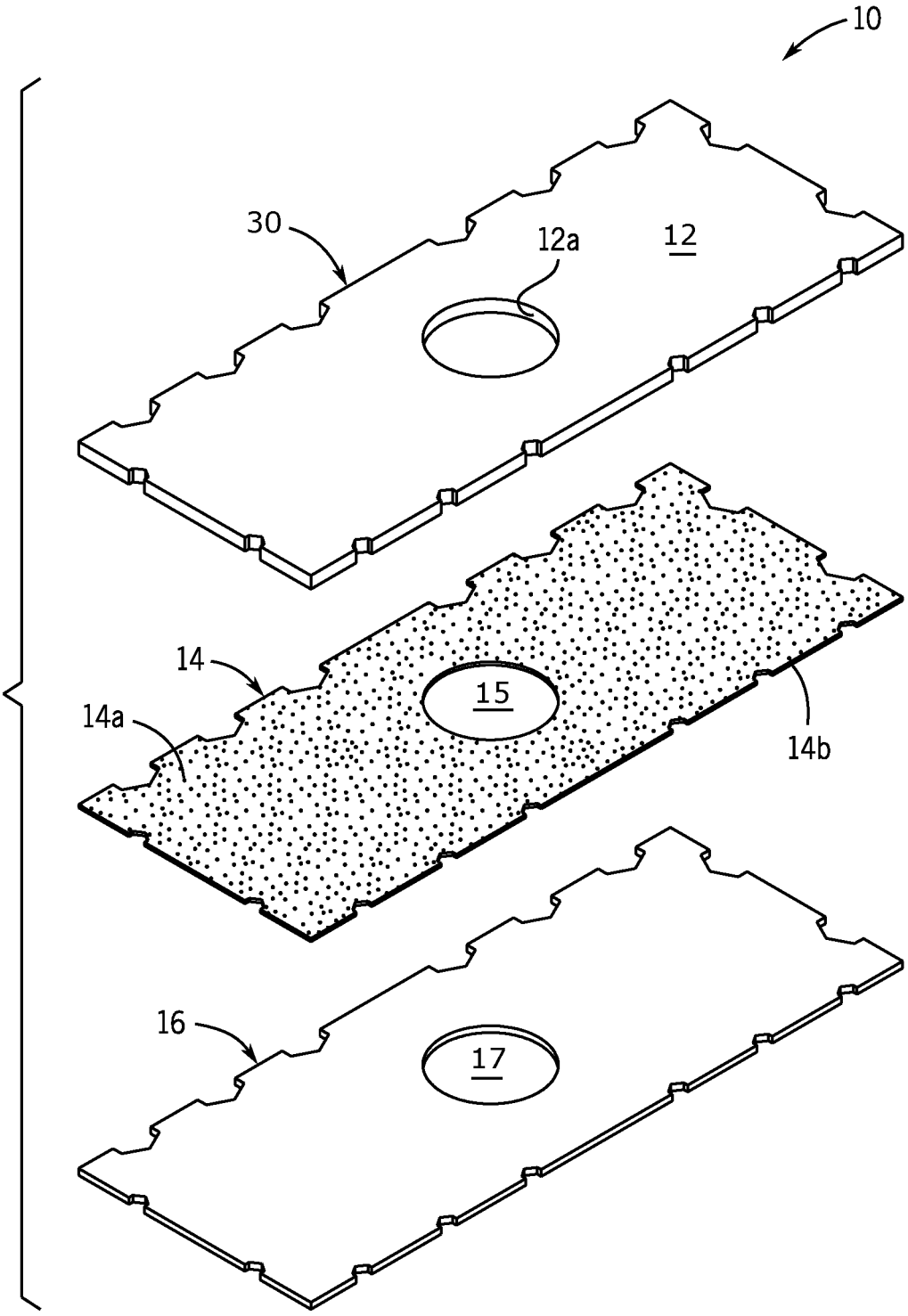
FIG. 1 is an exploded perspective view of an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a mattress securement device having a generally planar substrate sufficient to have one or more aperture that is circumscribed by peripheral multi-directional edges of the planar substrate. An adhesive along one side of the planar substrate enables the mattress securement device to be releasably adhered to a foundation on which a mattress is supported. The weight of the mattress urges a portion thereof into the one or more apertures and against the multi-directional edges, both of which resist the mattress moving or sliding relative to the foundation.

Referring now to FIGS. 1 through 4, the present invention may include a mattress securement device 10. The mattress securement device 10 provides one or more apertures 12*a* circumscribed by peripheral multi-directional edges 30. In certain embodiments, the mattress securement device 10 may include a first substrate 12 and an adhesive layer 14. Though in other embodiments, the adhesive layer 14 could be a coating or other application of adhesive on an otherwise unitary mattress securement device 10. The first substrate 12 is generally planar with the adhesive layer 14 along one of the planar surfaces. The adhesive layer 14 may be double-sided adhesive.

The first substrate 12 may be made of flexible substance constructed of polyurethane foam, rubber compound, open cell foam, and the like. The peripheral cut edges 30 may be multi-directional cuts to the outer perimeter of the substrate 12 and layers 14 and 16.

The apertures 12*a*, 15, and 17 may be centrally disposed but not necessarily round in shape. The surface area of each aperture 12*a* may range from ⅛ of an inch to four inches. The thickness of the first substrate 12 may range from one-sixteenth to one-half of an inch. In one embodiment, the first substrate 12 may be a sheet of polyurethane attached to the adhesive layer 14 and attached to the peel-away layer 16, and then cut and to the particular design shape or size. The mattress securement device 10 may be generally rectangular in shape, though any geometric shape may be used that facilitates the functionality disclosed herein.

The mattress securement device 10 may be positioned between the mattress 20 and foundation 22, which may be a box springs or the like as mentioned above. The material type and the peripheral multi-directional edges 30 are both adapted and dimensioned to frictionally engage the bottom surface of the mattress 20 and the top surface 22*a* of the foundation 22, thereby resisting movement. The first substrate 12 may be constructed of a ¼ -inch polyurethane foam however again, other sizes and "gripping" material are possible. In one embodiment, the adhesive layer 14 is preferably a double-sided adhesive that defines a first side 14*a* that is non-releasable attached to the first substrate 12, and a second side 14*b* that initially engages the peel-away layer 16, that in application may be releasably attached to either the foundation 22 or the mattress 20.

The method of operation for the preferred embodiment includes adhesively attaching the second side 14*b* to the top surface 22*a* of the foundation 22 such that the mattress securement device 10 is positioned under the mattress 20. The mattress 20 is then placed in its normal position on the mattress securement device 10. Once the mattress 20 is positioned on top of the foundation 22, the lower surface 20*a* of the mattress 20 will be urged by gravity into the at least one aperture 12*a*. This urging of the mattress 20 into the at least one aperture 12*a* increases the frictional connection between the mattress securement device 10 and mattress 20 and foundation 22. As a result, the application of this frictional connection causes the foundation 22 to adhere more strongly in place beneath the mattress 20, thereby providing greater resistance against the tendency of the mattress to move or slide relative to the foundation 22.

The polyurethane foam, or rubber, or similar open cell foam flat substance may be permanently laminated to the double-sided adhesive to create permeability.

This may be done by a commercial manufacturer to form a "sheet" that is approximately ¼" in thickness. Once the first substrate 12 is fabricated and laminated to the adhesive layer 14 and backing 16 it may be cut into the right size and shape as designed. One could accomplish the cutting of the multi-directional edges 30 with scissors or a shape knife and carefully cutting the design. However, the optimum cut may be made with a commercial die cutting machine usually a hydraulic cutting press, computer numeric control (CNC) cutting machine or water jet cutting machine. The shape and exact size of the gripper may vary by the need of the surfaces to which they are applied.

Figure 2:
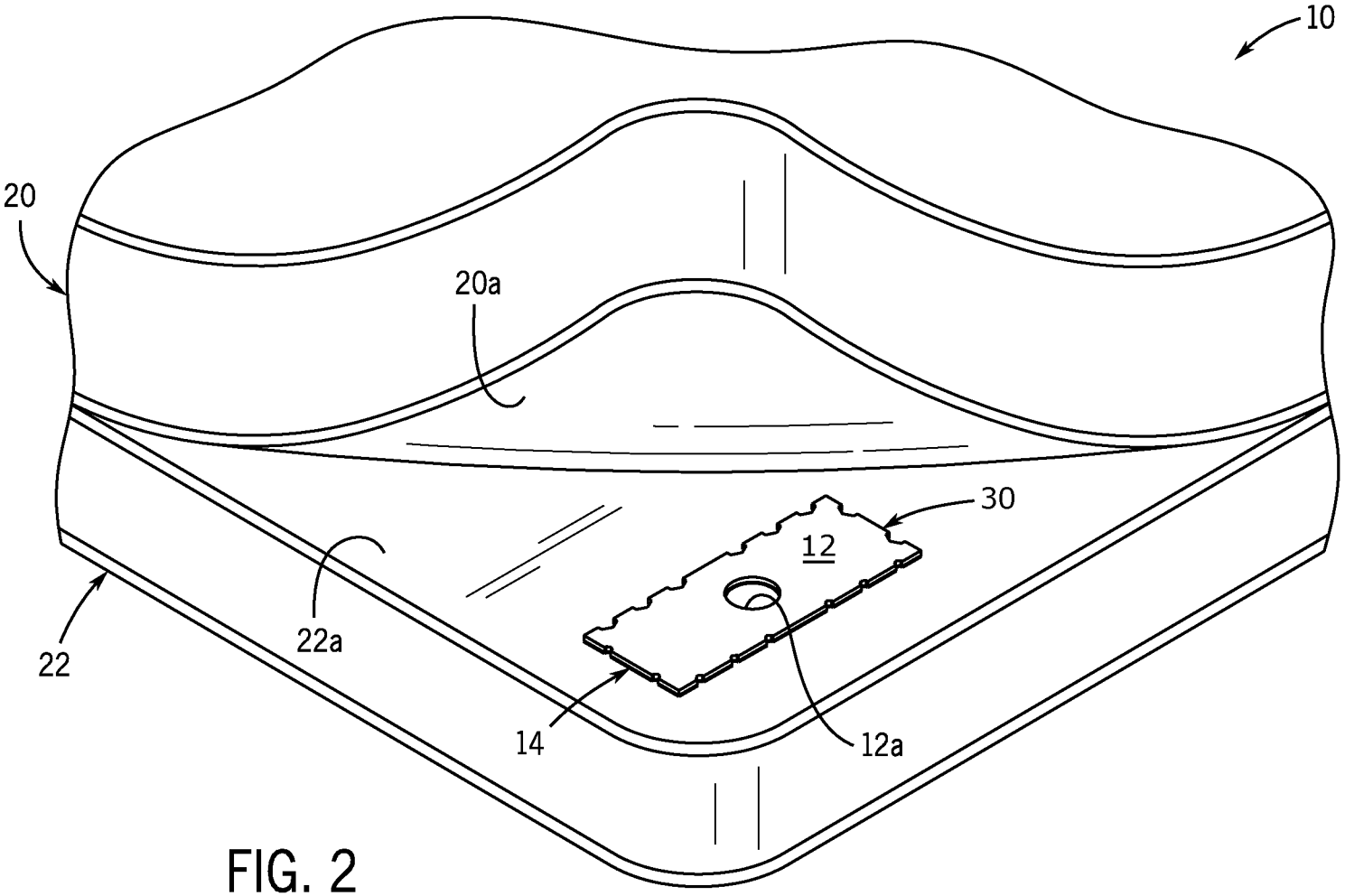
FIG. 2 is a detailed perspective view of an exemplary embodiment of the present invention.
Figure 3:
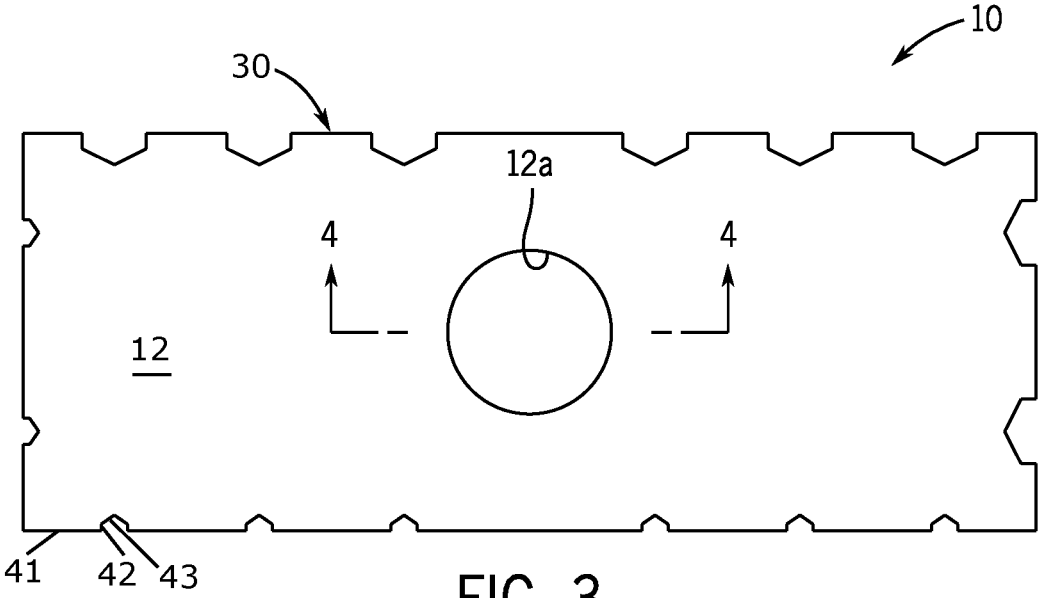
FIG. 3 is a top plan view of an exemplary embodiment of the present invention.

A method of using the present invention may include the following. The mattress securement device 10 disclosed above may be provided. When a user opens the package of the pre-cut mattress securement device 10 they then decide where they would like the mattress securement device 10 to be placed to produce the desired results. Once placement is established the user removes the peel-away layer 16 of the adhesive layer 14, slightly raises one part of the mattress 20, and attaches the mattress securement device 10 on the established place on top of the foundation 22 with the adhesive second side 14*b* downward, bonding it to the top surface 22*a* of the foundation 22, as illustrated in FIG. 2. The user would then place the mattress 20 down on the foundation 22 which makes the mattress securement device 10 no longer visible (between the mattress 20 and foundation 22) thus providing a neat appearance for the bed. Removing the mattress 20 completely from the foundation is not required.

Figure 4:
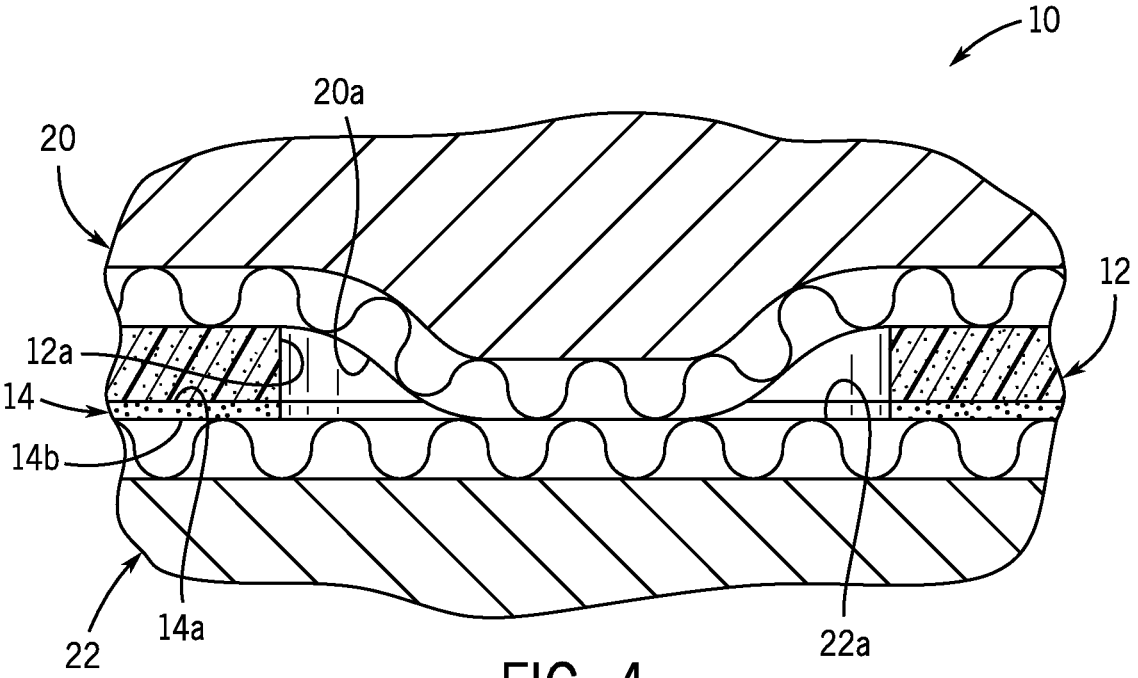
FIG. 4 is a detailed cross-sectional view of an exemplary embodiment of the present invention, taken along line 4-4 in FIG. 3.

Referring to FIG. 4, the weight of the mattress 20 urges a portion thereof into each aperture 12*a*. As a result, lateral movement of the mattress 20 is resisted by the circumferential edge of the apertures 12*a*. Likewise, though not shown, the mattress is also gravitationally urged against the multi-directional surfaces and facets of the peripheral cut edges 30, this engagement also resists lateral movement of the mattress 20 relative to the foundation 22, as the mattress securement device 10 is secured to the foundation by way of the adhesive. The peripheral cut edges 30 may include any shape, size, or cut. The peripheral cut edges can be triangular, half round, square, half octagonal or non-standard in size and shape, including a wavy pattern as long as the peripheral cut edges 20 result in the multi-directional surfaces and/or facets that increase the frictional drag and/or resistance contemplated herein. So long as the facets are more than a simple slit they will work. It must have an opening of ⅛" at a minimum to serve the purpose. But the spacing and shape would vary by the intended application.

The size and shape of the device and its apertures and facets will depend on the intended application; for example, a twin size mattress may not require the same size gripper as a king size mattress. And a set of sheets would require an entirely different size and shape than that of a mattress gripper. But they all require the apertures, facets, and the foam like substrate bonded to the self-adhesive layer.

Additionally, the mattress securement device 10 can be used to secure linens to a mattress and or foundation. This prevents the linens from lifting up and off the mattress, keeping the dust ruffle (also known as a bed skirt) in place on the foundation. The present invention can also be used to keep cushions on a couch or chair in place by placing it between the couch or chair and the cushion. The present invention can be used to hold almost any upholstered or fabric covered objects from sliding off one relative to the other. The objects need not be both upholstered surfaces, as the present invention can bond to one upholstered/fabric surface and one solid surface such as a wooden platform bed. Only one surface needs to be upholstered or fabric, preferably the top piece.

It should be understood, of course, that the foregoing relates to exemplary embodiments of the invention and that modifications may be made without departing from the spirit and scope of the invention as set forth in the following claims.

What is claimed is:

1. A mattress securement device, comprising:

a substrate that is planar and has a thickness that is within a range of one-quarter to one half of an inch;

an anchor keyhole formed in the substrate, wherein the anchor keyhole has a surface area within a range of three to four inches, wherein a valley defined by said thickness and said surface area receives a nested portion of a mattress during use so that lateral movement of the mattress is resisted by the nested portion engaging a circumferential edge of the valley;

the substrate having a top surface and an opposing bottom surface, wherein said surfaces are interconnected by a peripheral edge; and said peripheral edge of the substrate having a plurality of multi-directional facets, wherein each facet is oriented perpendicular relative to said surfaces, and wherein each facet is defined by a semihexagonal void in said surfaces, whereby each facet is configured to increase frictional engagement between the substrate and a mattress lain thereon.

2. The mattress securement device of claim 1, wherein the peripheral edge comprises at least two facets per linear inch.

3. The mattress securement device of claim 2, wherein each facet is a cutout of the peripheral edge.

4. The mattress securement device of claim 2, wherein each aperture of the one or more apertures has a surface area of at least one-eighth of an inch.

5. The mattress securement device of claim 1, further comprising:

an adhesive disposed along the bottom surface of the substrate.

6. The mattress securement device of claim 5, further comprising a peel-away layer along the adhesive.

7. The mattress securement device of claim 5, wherein the adhesive is a double-sided adhesive layer.

8. A method of preventing a mattress from sliding relative to a foundation that supports the mattress, the method comprising:

lifting a portion of the mattress from an upper surface of the foundation;

placing a mattress securement device of claim 2 in such a way that the adhesive adheres to the upper surface of the foundation; and laying the portion of the mattress onto said mattress securement device.

9. A mattress securement device, comprising:

an anchor keyhole formed in a substrate that is planar, wherein the anchor keyhole has a surface area within a range of three to four inches, wherein a valley defined by said thickness and said surface area receives a nested portion of a mattress during use so that lateral movement of the mattress is resisted by the nested portion engaging a circumferential edge of the valley;

the substrate having a top surface and an opposing bottom surface, wherein said surfaces are interconnected by a peripheral edge; and said peripheral edge of the substrate having a plurality of multi-directional facets, wherein each facet is oriented perpendicular relative to said surfaces, and wherein each facet is defined by a half polygon-shaped void in said surfaces, whereby each facet is configured to increase frictional engagement between the substrate and a mattress lain thereon.

* * * * *